United States Patent [19]

Anderson

[11] 4,089,508

[45] May 16, 1978

[54] METHOD OF PROCESSING BITUMINOUS PAVING MIXTURES AND APPARATUS THEREFOR

[75] Inventor: Willie E. Anderson, Alliance, Ohio

[73] Assignee: Alliance Industries, Inc., Alliance, Ohio

[21] Appl. No.: 658,903

[22] Filed: Feb. 18, 1976

[51] Int. Cl.[2] ..... B28C 1/22

[52] U.S. Cl. ..... 366/7; 366/25

[58] Field of Search ..... 259/148, 156, 158, 175, 259/146

[56] References Cited

U.S. PATENT DOCUMENTS

| | | | |
|---|---|---|---|
| 2,188,798 | 1/1940 | Smith | 259/151 |
| 2,487,887 | 11/1949 | McEachran | 259/158 |
| 3,674,242 | 7/1972 | Stewart | 259/158 |
| 3,693,945 | 9/1972 | Brock | 259/158 |
| 3,832,201 | 8/1974 | Shearer | 259/158 |
| 3,840,215 | 10/1974 | McConnaughay | 259/158 |
| 3,866,888 | 2/1975 | Dydzyk | 259/158 |

*Primary Examiner*—Richard E. Aegerter
*Assistant Examiner*—John W. Shepperd
*Attorney, Agent, or Firm*—Frease & Bishop

[57] ABSTRACT

A method of treating bituminous paving mixtures to reduce the amount of aggregate fines discharged into the atmosphere. Aggregate is fed into a charging end of an inclined drum mixer and is heated by a low-velocity gas stream to form steam from the moisture contained by the aggregate within a steam zone. Liquified asphalt is supplied to the aggregate in an asphalt injection zone as it moves downstream in the drum from the steam zone and coats the aggregate as it is tumbled and moved along the drum in a coating zone toward a discharge end. In the gas stream, the ratio of airflow into the drum mixer is accurately controlled with respect to the rate of fuel flow to a burner located at the charging end of the mixer, to consume during burner combustion all oxygen supplied by the airflow to produce a heated gas stream, thereby eliminating free oxygen from the interior of the drum mixer. The low-velocity heated gas stream travels through the drum and through the tumbling asphalt-coated aggregate in a lazy fashion toward a natural draft stack at the discharge end of the drum. The steam in the heated gas stream combines with tumbling coated aggregate during movement through the drum and assists in collecting aggregate fines in the final mix. The velocity of the gas stream is too low to entrain the aggregate fines in the gas stream as the latter rises through the stack. Thus, the fines settle on, adhere to and form a part of the asphalt coated aggregate.

The drum mixer has a deflector shield which is placed in the path of coated material flow adjacent the discharge end of the drum. The shield becomes sticky by the passage of the coated aggregate and attracts aggregate fines preventing their discharge from the stack.

12 Claims, 6 Drawing Figures

METHOD OF PROCESSING BITUMINOUS PAVING MIXTURES AND APPARATUS THEREFOR

BACKGROUND OF THE INVENTION

1. Field of the Invention

The invention relates to rotary drum mixer constructions for use in the making of bituminous paving mixtures and to the method of making such paving mixtures. More particularly, the invention relates to a method of making an asphalt paving mixture in a rotary drum using a low-velocity heated gas stream which moves through the drum with a velocity insufficient to entrain aggregate fines, resulting in reduction of a discharge of the fines into the atmosphere, eliminating the need of auxiliary emission control equipment heretofore required to meet clean air standards.

2. Description of the Prior Art

Bituminous paving mixtures for asphaltic concrete surfaces have heretofore been produced by drying a mixture of aggregate in an inclined rotary dryer unit, feeding the dried aggregate into a screening unit capable of separating the dried aggregate into various sizes, and then storing the dried and separated aggregates into hot bins. The sized aggregates then are withdrawn from the hot bins in the proper proportions by weight or volume and introduced into a pug or mixing mill where they are mixed with a predetermined amount of bitumen to produce the bituminous or asphaltic paving mixture. Such systems are referred to in the trade as "batch" type plants.

Burner systems utilized by such "batch" plants have been of the type whereby only a small amount of the air which is necessary for total fuel combustion is produced by the burner blower (generally 30% of total air). The balance of the air which is necessary for combustion is furnished by secondary air blowers, which are usually in the form of exhaust fans. These exhaust fans subject the drum dryer to a negative pressure which results in large quantities of dust or fines, which are inherent in the aggregate, being discharged into the atmosphere. Nearly all of the minus 200 mesh particles are lost through the exhaust system and discharged into the atmosphere. Such discharge makes it necessary for dust collectors and wet scrubber systems to be added to the asphalt plant in order to meet governmental clean air requirements. Even with the use of these stringent pollution controls, costing many thousands of dollars, it is still very difficult to meet these requirements.

Other asphalt processing systems use an inclined rotary drum as a combination drying and mixing unit. In these systems aggregate is introduced into the upper end of a heated drum and coated with an emulsion or asphaltic material which is sprayed or pumped into the stream of moving aggregate. The asphalt coated aggregate then is discharged as a finished paving mix from the drum ready for use. Since the rescreening, mixing towers and batching systems are eliminated in this rotary drum type plant, it may be produced for sale at a lower cost, resulting in lower investments for asphalt producers.

The burner and exhaust systems of these drum mixers are similar in most respect with the systems in use in standard batch plants. Although the injections of liquid asphalt in the drum traps a large portion of the aggregate fines, the exhaust fan still withdraws a large percentage of these fines from the drum and mix. This requires expensive emission control equipment which adds thousands of dollars to the initial purchase price and maintenance of these units.

Examples of such rotary drum asphalt plants and other types of asphalt and material mixing systems are set forth in U.S. Pat. Nos. 1,240,481, 2,188,798, 2,028,745, 2,626,875, 3,423,222, 3,614,071, and 3,832,201.

Recent asphalt plants and systems have been concerned with the elimination or reduction of aggregate fines and other particulate matters from being discharged into the atmosphere in order to meet governmental clean air standards, and to reduce the amount of pollution control equipment required to meet such standards. Systems such as shown in U.S. Pat. No. 3,614,071 spray liquid asphalt onto the moving aggregate within a mixer drum to coat the aggregate with the asphalt and particularly to trap the aggregate fines in the mix before the fines are emitted into the atmosphere through the exhaust stack. Other systems, such as shown in U.S. Pat. No. 3,832,201 coat the aggregate with liquid asphalt while the aggregate is in a cold, wet condition prior to drying the aggregate in the drum in an attempt to eliminate or reduce emission of the aggregate fines into the atmosphere.

Such systems, however, still require the use of exhaust blowers to draw air into the inlet end of the rotary drum, through the drum, and then out of an exhaust stack. The heated gas stream which moves through the drum, also has a relatively high velocity due to the use of these exhaust blowers. These exhaust blowers increase considerably the initial plant equipment cost as well as the operating cost, due to the amount of electricity required to operate the blower. These exhaust blowers usually require a large horsepower motor which consume a large portion of the electrical energy requirements of an asphalt processing plant.

No asphalt processing system or method of which I am aware controls the emission of aggregate fines into the atmosphere by providing a heated gas stream which moves in a lazy-like fashion through the drum, which gas stream has a velocity sufficiently low to prevent suspension or entrainment of the aggregate fines in the airflow by using a natural draft stack at the discharge end of the drum and by controlling the air-fuel ratio to the drum burner, thereby eliminating exhaust blowers or fans of any type.

SUMMARY OF THE INVENTION

Objectives of the invention include providing a new method and procedure for processing bituminous paving mixtures in a rotary drum-type plant to reduce or eliminate the discharge of aggregate fines into the atmosphere, in which a heated gas stream moves through the drum with a low velocity, insufficient to support or entrain the particulate fines; providing such a procedure which uses a natural draft stack at the discharge end of the rotary drum eliminating the use of exhaust fans or blowers heretofore used to create a high velocity airflow through the drum, thereby reducing considerably the initial cost of the plant equipment as well as the operating cost, by reducing the electrical requirements of the asphalt processing plant; providing such a procedure in which the moisture content naturally occurring in the stored aggregate due to ambient conditions, is converted into steam immediately upon the aggregate entering the rotating drum, which steam moves with the heated gas stream through the drum and aids in the dispersion of the liquidus bitumen or asphalt which is introduced into the drum downstream of the steam generation zone, and in which the steam further aids in emission control by collecting and retaining very small lightweight aggregate fines and dust particles in the paving mixture, and which steam results in some retained moisture within the final paving mixture to provide better compaction with lighter weight compacting paving equipment and to provide greater density in pavement core samples; providing such a new procedure and method in which the ratio of the air and fuel flows, which are supplied to a burner mounted on the drum at the charge end, is accurately controlled, whereby combustion of the air and fuel produces a heated gas stream in which nearly all oxygen is consumed during the combustion to eliminate free oxygen from the low-velocity heated gas stream producing a generally inert atmosphere within the drum, resulting in less oxidation of the asphalt and less loss of penetration of the asphalt; providing such a new procedure and method in which the exhaust stack emissions can be maintained within existing, established government regulations without the use of external emission control devices, such as dust collectors and wet scrubbers; providing such a procedure and method which enables greater efficiency and savings in fuel cost by closely controlling the combustion air-fuel flow mixture, and which enables a substantial savings in initial plant equipment cost and electrical operating requirements; and provides such a method and procedure which eliminates difficulties heretofore encountered in prior asphalt processing systems, achieves the various objectives indicated in a practical, workable and easily controlled and inexpensive manner, and which solves problems and satisfies needs which have long existed in the art.

Further objectives of the invention include providing a rotary drum mixer having a deflector shield mounted within the interior of the drum within the path of the asphalt-coated aggregate material as it progresses towards the discharge end of the drum, which shield becomes sticky by the passage of the coated material thereby attracting small particulate matter and aggregate fines, which otherwise might be emitted into the atmosphere from the emission stack.

These objectives and advantages are obtained by the improved method of processing bituminous paving mixtures to reduce discharge of aggregate fines into the atmosphere, the general nature of which may be stated as including the steps of, providing a substantially airtight inclined drum mixer having an upper charging end and a lower discharge end; providing a low-velocity heated gas stream within the drum moving from a zone adjacent the charging end through the drum to the discharge end; feeding aggregate having a variable moisture content into the drum at the charging end; immediately heating the introduced aggregate by the heated gas stream to dry the aggregate and produce steam from the aggregate moisture content; tumbling and moving the heated aggregate along the drum toward the discharge end in the heated steam-containing gas stream; feeding a liquified asphalt composition into the tumbling heated aggregate moving through the drum at a zone generally intermediate the charging and discharge end of the drum; continuing the tumbling of the aggregate and liquified asphalt moving in the heated gas stream along the drum to coat the aggregate with the liquified asphalt; then discharging the coated aggregate from the drum; meanwhile controlling the air-fuel flow ratio of combustion producing the heated gas stream such that nearly all oxygen is consumed during combustion to generally eliminate free oxygen from the low-velocity heated gas stream moving through the drum; and discharging the low-velocity heated gas stream from the drum discharge end through a natural draft stack, whereby the gas stream has low velocity, insufficient to entrain aggregate fines therein, and whereby the fines are contained in the discharge coated aggregate.

These objectives and advantages are obtained further by an improved rotary drum mixer construction, the general nature of which may be stated as including, an inclined cylindrical aggregate drum mixer having an upper charge end for receiving untreated aggregate, and a lower discharge end for discharging a bituminous paving mixture; means for rotating the drum mixer about its longitudinal axis; vane means mounted on the interior of the drum mixer and arranged to tumble and move aggregate along the drum mixer during rotation thereof; burner means positioned adjacent the charge end of the drum mixer for immediately heating aggregate fed into the drum mixer; bituminous supply means for injecting liquidus bituminous into the drum mixer downstream of the charge end; shield means mounted within the drum mixer in the path of the aggregate in proximity with the discharge end for attracting small particulate matter within the aggregate; the shield means includes circular plate means mounted concentrically within the drum mixer and having a diameter approximately one half of the drum mixer diameter; the circular plate means having upper and lower semicircular plates with the upper plate being fixed with respect to the drum mixer and with the lower plate being pivotally mounted on the upper plate for swinging movement toward the discharge end of the drum mixer; and stop means mounted on the interior of the drum mixer and engageable with the lower semicircular plate to limit pivotal movement of the lower plate toward the discharge end of the drum mixer.

BRIEF DESCRIPTION OF THE DRAWINGS

The preferred embodiment of the improved apparatus and method steps for processing bituminous paving mixtures — illustrative of the best mode in which applicant has contemplated applying the principles — are illustrated in the drawings and set forth in the following description and are particularly and distinctly pointed out and set forth in the appended claims.

DESCRIPTION OF THE PREFERRED STEPS OF THE IMPROVED METHOD AND APPARATUS THEREFOR

Figure 2:
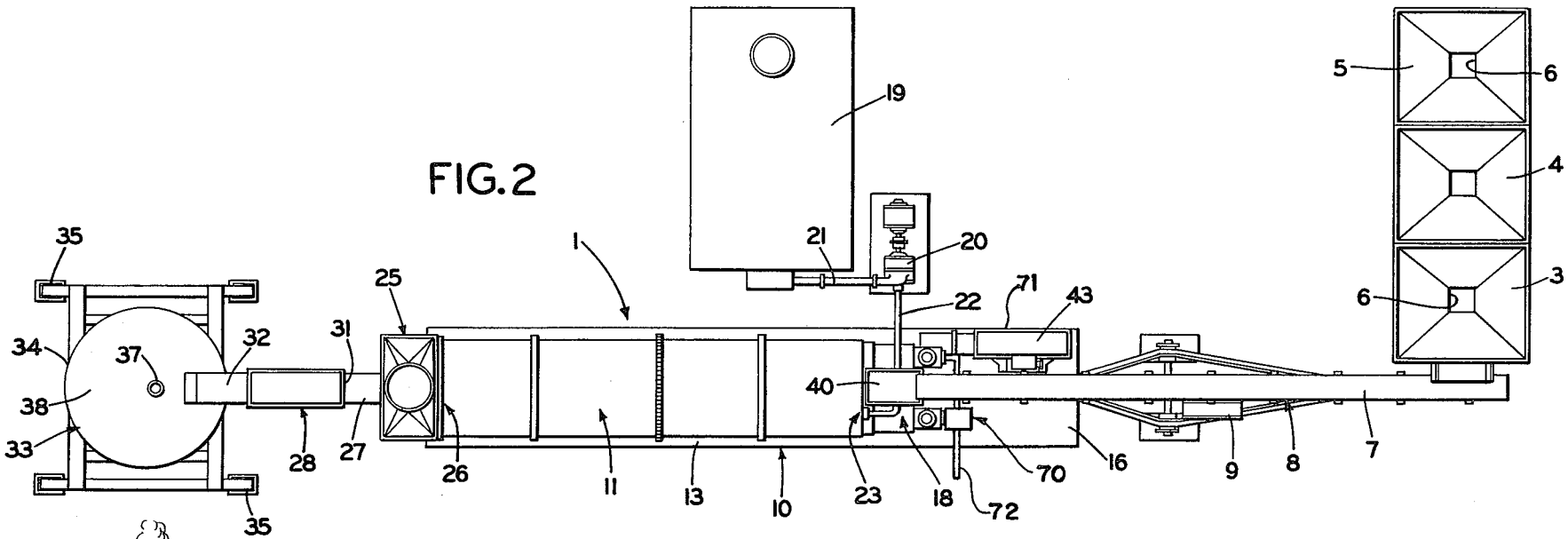
FIG. 2 is a top plan view of the asphalt processing plant and apparatus of FIG. 1.
Figure 1:
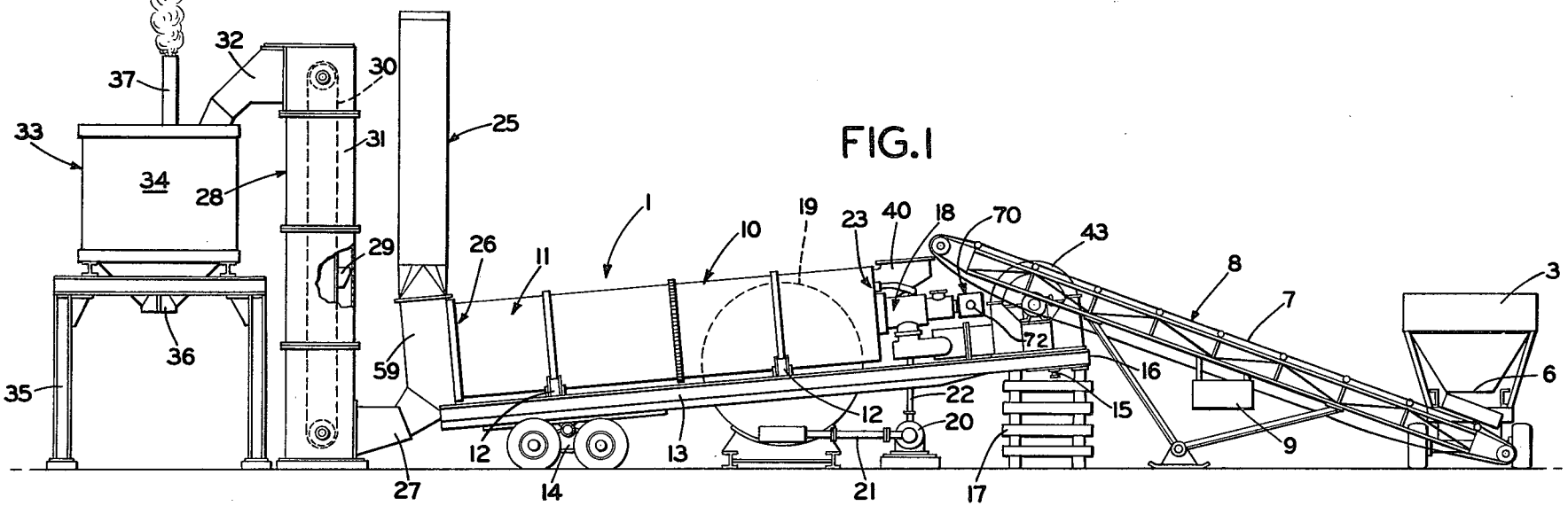
FIG. 1 is a generally diagrammatic side elevational view of an asphalt processing plant for carrying out the steps of the improved method, and which contains the improved apparatus.

A drum type asphalt processing plant for carrying out the steps of the improved method is shown diagrammatically in FIGS. 1 and 2, and is indicated generally at 1. Plant 1 includes a plurality of cold aggregate feed bins 3, 4 and 5 in which various sized aggregate is stored. Bins 3–5 are provided with adjustable flow rate gates and automatic controls (not shown) for accurately depositing the desired amount of the various aggregates through bottom bin openings 6 onto a belt 7 of a cold feed conveyor 8. Conveyor belt 7 is provided with a scale 9 which accurately weighs all material deposited on the belt, which in turn is fed into an improved drum mixer assembly 10.

Drum mixer assembly 10 includes an inclined cylindrical drum mixer 11 which is supported for rotation about its longitudinal axis on rollers 12, which in turn are mounted on a trailer frame 13. Frame 13 preferably is portable and includes wheel-axle assemblies 14 adjacent one end, with hitch means 15 at opposite frame end 16 for attachment to a truck or the like. Frame end 16 preferably is mounted on a supporting structure 17 having a predetermined height to impart the desired angle of inclination to drum 11.

A burner assembly, indicated generally at 18, is supported on frame end 16 and communicates with the upper or charging end 23 of drum 11. An asphalt storage tank 19 is positioned adjacent drum mixer assembly 10. Storage tank 19 is insulated and includes heating means to maintain a supply of asphalt stored therein at a predetermined temperature. An asphalt pump 20, preferably of the variable speed type containing a metering system (not shown), is connected to and pumps liquified asphalt from tank 19 into drum 11 by connecting pipes 21 and 22.

In accordance with the invention, a natural draft stack 25 communicates with a lower or discharge end 26 of drum 11. A discharge chute 27 extends between the lower end of stack 25 and drum discharge end 26 and the bottom of an elevator assembly 28. Assembly 28 may have various internal paving mixture conveying equipment such as a plurality of buckets 29 mounted on an endless chain 30 as shown in FIG. 1, or the equipment may be of the drag or enclosed belt types without departing from the concept of the invention. Buckets 29 deliver the hot bituminous asphalt mixture, which is discharged from drum 11 upwardly through elevator shaft 31, through elevator discharge chute 32, and into an insulated storage hopper assembly 33.

Hopper assembly 33 is of a usual construction having an enclosed insulated hopper bin 34 supported sufficiently above the ground on a network of steel beams 35 to permit trucks to drive beneath bin 34 for receiving a load of paving mixture through a bottom discharge gate 36. A vent pipe 37 extends through top wall 38 of bin 34, through which steam, heat vapor, etc., are discharged into the atmosphere, and which serves as an indication means for level indication of paving mixture in the bin.

The general asphalt plant assembly 1 described above and shown particularly in FIGS. 1 and 2, except for natural draft stack 25, is typical for various rotary drum-type asphalt processing plants. In the usual operation of such plants, predetermined quantities of various sizes of aggregates are fed from bins 3–5 onto conveyor belt 7 and deposited through an inlet opening 39 of a feed chute 40 into the charging end of drum 11. The aggregate then is dried and coated with heated liquid asphalt in accordance with the steps of the improved method of the invention, described in detail below. The coated asphalt passes through discharge chute 27 into and upwardly through elevator assembly 28, and then is deposited in storage hopper assembly 33 for transfer to trucks for delivery to a paving site.

In accordance with the invention, drum mixer 11 is substantially airtight, with the air and fuel ratio which is supplied to burner assembly 18 through air inlet openings 71 and fuel supply line 72 being accurately controlled. Upon combustion of the fuel and air all of the oxygen is consumed, producing a heated gas stream 41 which is relatively free of oxygen. Outside air which may enter drum 11 upon passage of the aggregate through a flapper gate which covers chute opening 39, in addition to any air which passes between the end of rotating drum 11 and burner assembly 18 and similar small openings, is taken in account in determining the air flow into burner chamber 42 created by combustion air blower 43.

Burner assembly 18, preferably, is of the low-pressure air atomizing type, and nearly all of the air necessary for fuel combustion is passed through the burner eliminating the need for secondary air or exhaust fans. A series of burners, any one of which may be used for carrying out the invention is manufactured and distributed by Alliance Industries Inc., of Alliance, Ohio. These burner are designated as models E-M150 through E-M600 and vary in size to match the particular size of drum mixer 11. Various other burners used in usual known asphalt processing systems may be used to provide the desired air-fuel flow ratio without affecting the improved method such as the burners and air/oil regulators manufactured by North American Mfg. Co. of Cleveland, Ohio, under the trademarks Magna-Flame Burners and Air/Oil Ratiotrols, respectively, indicated in the drawings generally at 70.

Figure 3:
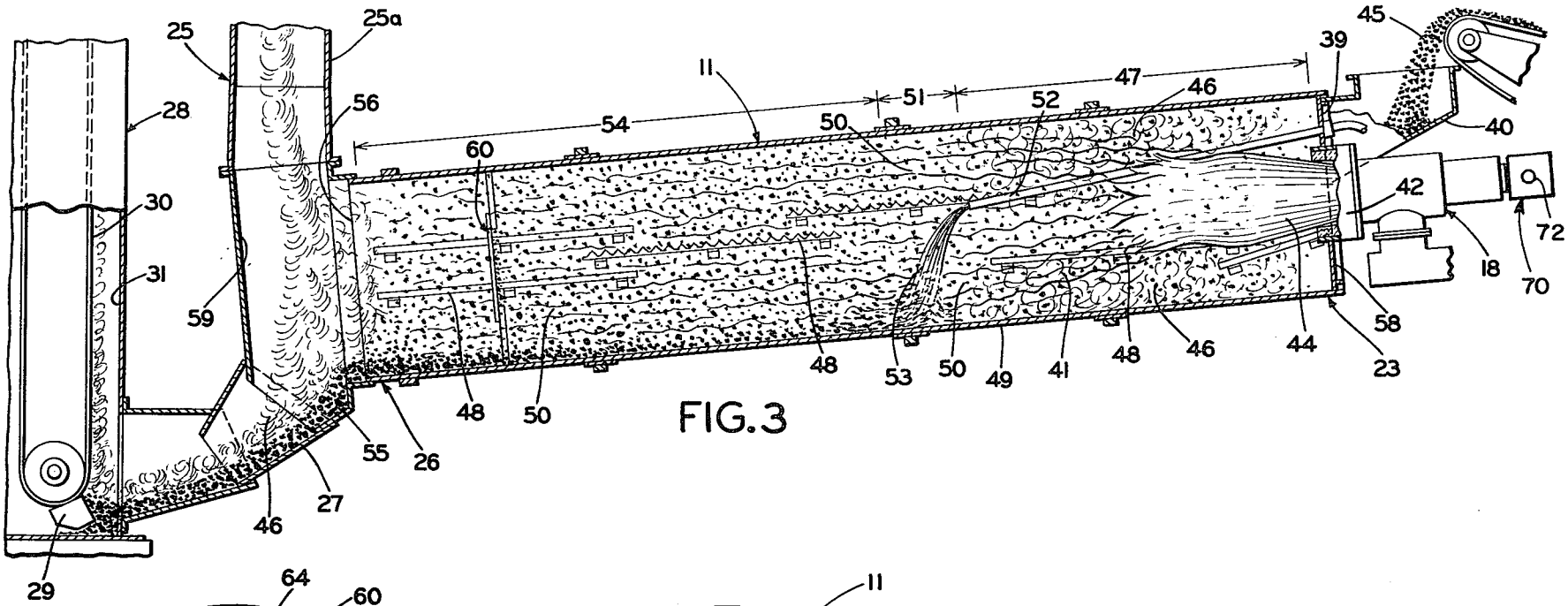
FIG. 3 is a vertical cross-sectional view of the improved drum mixer of FIGS. 1 and 2 which is used in carrying out the steps of the improved method showing diagrammatically the processing of the asphalt mixture within the drum.

In carrying out the steps of the invention, predetermined amounts of weighed aggregate 45 is fed through opening 39 of chute 40 into the charging end 23 of drum 11 (FIG. 3). Aggregate 45 is in its untreated, cold, wet condition, taken directly from storage and containing various amounts of moisture. The moisture content of aggregate 45 generally will be within the range of from 1% to 7% of the aggregate weight depending upon the ambient conditions, recent rainfall, season of the year, geographical location, etc.

Aggregate 45 passes through a flame 44 produced by burner assembly 18, and is immediately heated by the flame and the heated gas stream 41 upon entering charging end 23 of drum 11. The flame and gas stream dry the aggregate and produce steam 46 from the moisture content within the aggregate. This drying and steam generation takes place within a zone indicated at 47, which is adjacent to and extends downstream from the charging end of drum 11 and is referred to as a steam generation zone. Steam zone 47 may occupy an area approximately one third of drum 11, as shown in FIG. 3.

Figure 4:
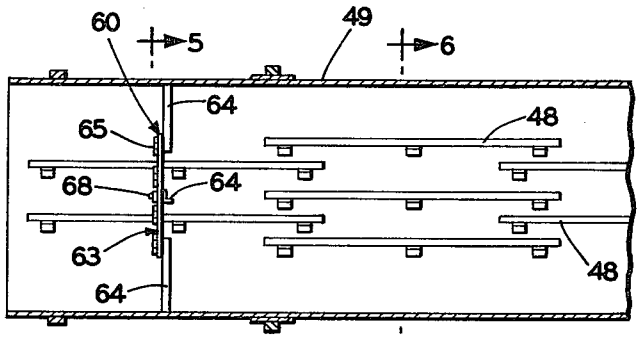
FIG. 4 is an enlarged sectional view of the left-hand end of the drum mixer of FIG. 3, showing portions of the tumbling vanes and new deflector shield mounted within the drum mixer.
Figure 6:
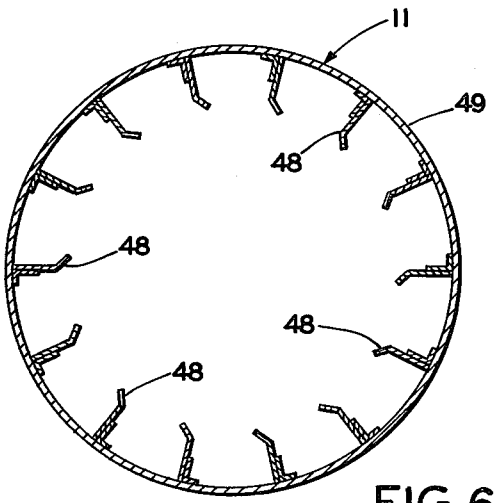
FIG.6 is an enlarged sectional view taken on line 6—6, FIG. 4, showing the spaced arrangement of the tumbling vanes.

Aggregate 45, upon entering drum 11, is tumbled and moved along the drum by a plurality of vanes 48 (FIGS. 3, 4 and 6) which are mounted on cylindrical side wall 49 of drum 11. Vanes 48 extend radially inwardly toward the drum axis, as shown in FIG. 6, as well as extending along drum wall 49, parallel with the axis of drum 11 (FIG. 4). The aggregate is continuously being lifted, agitated and dropped through heated gas stream 41 and through flame 44 as it is moved through steam zone 47 by vanes 48.

The heated and dried aggregate moves along the drum in the heated gas stream which now contains the generated steam 46, with the heated steam-containing gas stream being indicated at 50. The aggregate leaves steam zone 47 and enters an asphalt injection zone 51. Zone 51 is located immediately adjacent to and downstream of steam zone 47. Heated liquid asphalt 53 is pumped from asphalt storage tank 19 through a delivery pipe 52. Pipe 52 extends through a drum end plate 58, and generally axially along the interior of drum 11. The heated liquid asphalt 53 is ejected from the end of pipe 52 into the tumbling, cascading, dried aggregate in asphalt injection zone 51 and begins coating the aggregate with the liquified asphalt.

Aggregate 45 and liquified asphalt 53 continues to be tumbled and moved along drum 11 within the heated steam-containing gas stream 50, downstream toward the discharge end 26 of the drum within a coating zone 54 (FIG. 3). Coating zone 54 is located adjacent to, and downstream of, asphalt injection zone 51. The major portion of the aggregate becomes coated in the area of coating zone 54 immediately adjacent asphalt injection zone 51 with the remaining aggregate becoming coated with the liquid asphalt as it tumbles and moves along coating zone 54, to form the final desired asphaltic paving mixture 55. Paving mixture 55 then is discharged through the open end 56 of drum 11 into and along discharge chute 27, into the bottom of elevator shaft 31. Mixture 55 then is transported by buckets 29 into hopper assembly 33, as described above.

In accordance with one of the main features of the invention, natural draft stack 25 communicates with the open discharge end 56 of drum 11 at an enlarged breech chamber 59, the bottom of which communicates with discharge chute 27. The major portion of the heated steam-containing gas stream 50 is passed into breech chamber 59 and upwardly through upper stack portion 25*a* and to the atmosphere. Portions of steam 46 will pass through breech chamber 59 and through discharge chute 27, and will combine with paving mixture 55. Steam 46 remaining in the paving mixture, results in the final mix having better compaction qualities, requiring lighter road paving equipment to achieve the desired compaction, and provides a greater, more desirable material density in core samples taken of the finished pavement.

Other portions of this residual steam move through elevator assembly 28 and into storage hopper 33, and are eventually dispersed into the atmosphere through vent pipe 37 (FIG. 1). Steam 46 also aids in the control of particulate matter emission into the atmosphere by combining with the small light-weight particles and aggregate fines, keeping them in the paving mixture by adhering them to the asphalt-coated aggregate.

One of the important features in carrying out the steps of the improved method is the control and creation of heated gas stream 41. The ratio of the airflow and fuelflow to burner assembly 18 is accurately controlled so that upon combustion nearly all of the oxygen of the airflow is consumed during combustion to eliminate free oxygen from the heated gas stream. The control of this ratio is accomplished by usual burner control equipment 70 which forms no part of the invention. This inert atmosphere created within drum 11 prevents premature hardening of paving mixture 55 and oxidation of the mixture. This complete combustion of the air flowing into the drum, in combination with natural draft stack 25, maintains the velocity of heated gas stream 41 and subsequent steam-containing gas stream 50 at a low velocity. This low velocity is insufficient to entrain and maintain suspended therein, the fine particulate matter, dust and aggregate fines which heretofore have been discharged into the atmosphere. It is the elimination or substantial reduction of this emission which creates the pollution problems, which are overcome by the improved method.

This low-velocity gas stream travels through the drum and through the tumbling curtain of coated and uncoated aggregate in a lazy-like fashion from charging end 23, to and upward through natural draft stack 25. The accompanying tables set forth the relationships and characteristics of the airflow velocity through drum 11 and stack 25 depending upon the drum size, which provides the desired results of the invention. These charts set forth several typical processing conditions and do not include all of the various sizes and operation characteristics for carrying out the steps of the improved method.

Column 1 sets forth the particular asphalt processing plant size in tons per hour, with the various drum and stack characteristics for the particular plant size being set forth in Tables 1 and 2. Column 4 sets forth the maximum airflow (heated gas stream 41) in cubic feet per minute, which flows through the drum. This flow rate is based upon the burner assembly operating at near maximum capacity, which condition in most situations will not be reached. Column 5 sets forth the average flow rate which will be the usual operating level for the various sized plants of column 1. Column 6 sets forth the maximum steam flow within the drum based upon a 5% moisture content in aggregate 45 and a final discharged paving mixture temperature of 240° F. These steam flow figures will vary depending upon the moisture content of the particular aggregate, as well as the final mix temperature. The figures of column 6 are merely representative of a particular operating parameter and are for purposes of illustration. Column 7 sets forth the average and maximum flow rates through the drum, which rates are the total of the air and steam flows of column 4–5 and 6. Column 8 sets forth the minimum, average and maximum drum velocities in feet/minute of the heated steam-containing gas stream 50 moving through drum 11, which in accordance with one of the main features of the invention, is of a velocity too low to support and entrain aggregate fines and other particulate matter therein.

Table 2 sets forth the steam and heated steam-containing gas stream flow rates occurring in natural draft stack 25. Column 10 sets forth the maximum steam flow rate for the various plant sizes, which values are 50% of the values of column 6. Tests have indicated that approximately 50% of steam 46 which flows through the drum, flows upwardly through the stack and into the atmosphere. The remaining 50% of the steam flows through discharge chute 27 with paving mixture 55, and is subsequently discharged into the atmosphere through vent pipe 37 of hopper 34. The steam flow rates of column 10 are combined with the flow rates of columns 4 and 5 to arrive at the figures of column 11, which in turn provide the range of stack velocities for the various size plants set forth in column 12.

The values of the various operating characteristics of Tables 1 and 2 may vary between particular plants of the same size, depending upon the type of paving mixture being produced, the moisture content of aggregate 45, the temperature of final paving mixture 55, the firing rate and efficiency of burner assembly 18, etc. Thus, the flow rate of the heated steam-containing gas stream within drum 11 usually will be within the range of from 240 feet/minute and 540 feet/minute, with the flow rate or stack velocity being within the range of from 425 feet/minute to 900 feet/minute. These velocities are too low to carry the suspended particles into the atmosphere. The stack velocities are measured near the top of breech 59 with temperature probes being located within discharge chute 27 adjacent drum discharge opening 56 for measuring the temperature of the paving mixture.

small particulate matter and aggregate fines being carried along the drum in the gas stream and tumbling aggregate, which particles otherwise may attempt to ascend stack 25. These particulate matters eventually will be attached to and combined with the subsequent coated aggregate as it strikes the shield and moves toward the discharge end.

Accordingly, the present invention provides substantial improvements in the art of making bituminous paving mixtures and provides an improved apparatus therefor. The improved process eliminates the need of external air pollution control equipment by producing a low-velocity air movement through the drum by the use of a natural draft stack in combination with a particular burner arrangement which consumes all of the free oxygen within the drum during combustion by accurately controlling the fuel-airflow ratio.

The cross-sectional area of stack breech 59 is larger than the cross-sectional area of upper stack portion 25*a*,

TABLE 1

| | | | | (DRUM CHARACTERISTICS) | | | | | | |
|---|---|---|---|---|---|---|---|---|---|---|
| (1) TPH | (2) Drum Dia. In. | (3) Drum Len.Ft. | (4) Max. Air Flow CFM | (5) Avg. Air Flow CFM | (6) Max. Steam Flow 5%-240° F | (7) Drum Flow CFM Avg. | (7) Drum Flow CFM Max. | (8) Drum Vel. FM Min. | (8) Drum Vel. FM Avg. | (8) Drum Vel. FM Max. |
| 40 | 48 | 25 | 1500 | 1200 | 2333 | 3533 | 3833 | 257 | 281 | 305 |
| 60 | 60 | 25 | 2084 | 1670 | 3500 | 5170 | 5584 | 242 | 263 | 284 |
| 80 | 72 | 25 | 3834 | 3073 | 4666 | 7739 | 8500 | 247 | 274 | 301 |
| 100 | 72 | 30 | 5750 | 4609 | 5833 | 10442 | 11583 | 328 | 369 | 410 |
| 150/180 | 84 | 30 | 8435 | 6748 | 8750 | 15498 | 17185 | 360 | 403 | 446 |
| 250 | 96 | 40 | 12526 | 10021 | 14583 | 24604 | 27109 | 439 | 489 | 539 |

TABLE 2

| | | STACK (CHARACTERISTICS) | | | | | |
|---|---|---|---|---|---|---|---|
| (1) TPH | (9) Stack Size | (10) Steam Flow Max. CFM | (11) Stack Flow CFM Avg. | (11) Stack Flow CFM Max. | (12) Stack Vel. FM Min. | (12) Stack Vel. FM Avg. | (12) Stack Vel. FM Max. |
| 40 | 30"×30' | 1167 | 2367 | 2667 | 506 | 579 | 652 |
| 60 | 36"×30' | 1750 | 3420 | 3834 | 426 | 484 | 542 |
| 80 | 36"×30' | 2333 | 5406 | 6167 | 658 | 765 | 872 |
| 100 | 42"×36' | 2917 | 7526 | 8667 | 663 | 782 | 901 |
| 150/180 | 54"×36' | 4375 | 11123 | 12810 | 594 | 700 | 806 |
| 250 | 66"×45' | 7292 | 17313 | 19818 | 624 | 729 | 834 |

Figure 5:
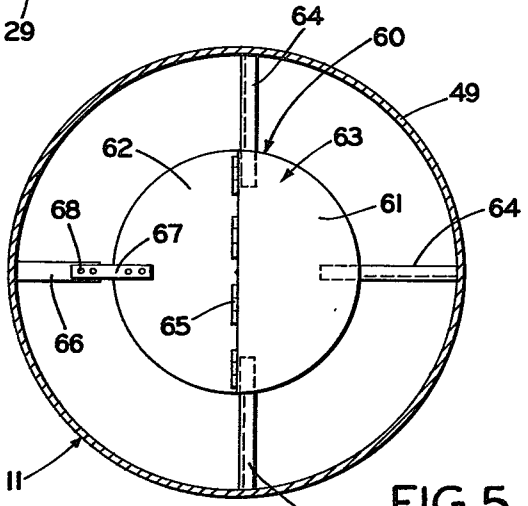
FIG. 5 is an enlarged sectional view taken on line 5—5, FIG. 4, showing the new deflector shield mounted within the drum mixer for attracting small particulate matter.

Another important feature of the invention is the control of particulate emission by the use of a deflector assembly 60 (FIGS. 4 and 5) which is placed in drum 11 in the path of the coated aggregate. Assembly 60 includes a circular shield 63 formed by a pair of semi-circular plates 61 and 62, respectively. Plate 61 is welded on the extended end of three radially extending angle irons 64 which in turn are welded to drum wall 49. Other plate 62 is pivotally mounted by hinge 65 to plate 61 for swinging movement toward charging end 23 of the drum. A fourth angle iron 66 is mounted on and extends radially inwardly from drum wall 49 toward plate 62 and engages a latch bar 67 extending from plate 62. Bar 67 may be secured to angle iron 66 by bolts 68. Latch bar 67 prevents pivotal movement of plate 62 during operation of drum 11 and is provided to enable a workman to enter drum discharge end opening 56 and move past shield 63 for internal drum maintenance. Shield 63, formed by plates 61 and 62, is mounted concentrically within drum 11 and has a diameter approximately one half of the diameter of drum 11.

Shield 63 is continuously contacted by the coated aggregate as it moves through coating zone 54 toward discharge opening 56 and becomes sticky from the asphalt which will adhere to the shield. This sticky surface in the path of the moving gas stream will attract and provides a chamber in which the flow rate of the steam-containing gas stream 50 decreases upon entering. This further reduction in velocity results in the drop-out of additional particulate matter which may be moving along with stream 50. Thus, this enlarged breech 59 further aids in the control of particulate emission.

The operating characteristics set forth in Tables 1 and 2 above, provide for an average aggregate retention time within drum 11 of between 3 and 4 minutes. Thus, aggregate 45 upon entering opening 39 at drum charging end 23, is dried, coated, and moved along drum 11 by vanes 48 for approximately 3 or 4 minutes before being discharged through opening 56 into chute 27.

The improved method has the further advantage of being able to control particulate emission and still use a simple asphalt injection pipe 52, instead of requiring a plurality of spray nozzles as in some prior processes and apparatus. Problems are occasionally encountered in equipment using asphalt spray nozzles in that the small nozzle openings become clogged, especially upon solidifying of the liquid asphalt during production batches. This clogging problem is eliminated by the single enlarged delivery pipe 52 of the present invention.

Deflector shield assembly 60 provides additional means of reducing particulate emission in a simple, inexpensive, maintenance-free manner within drum 11. Shield 63 is continually being coated by sticky liquid asphalt 53 from the passing, coated aggregate, which attracts additional particulate particles. Shield 63 is continually being wiped free of these trapped particles by the bombarding action of the subsequent tumbling, moving aggregate.

The improved method and apparatus results in considerable savings in initial plant investment by the complete elimination of exhaust blowers and fans heretofore used in cooperation with an exhaust stack in all known asphalt processing plants. Furthermore, the elimination of such exhaust blowers and fans further reduces the operating cost of the plant by reducing considerably the electrical power requirements heretofore required for the operation of such fan motors. Also, initial plant equipment and operating costs are reduced by elimination of external air pollution control equipment required by known plant constructions in order to conform to governmental clean air standards. Furthermore, the improved method and apparatus satisfies the various objectives set forth above, solves problems, and satisfies demands existing in the art, and obtains the new results indicated.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved method of processing bituminous paving mixtures is carried out, the characteristics of the improved apparatus, the characteristics of the new concepts and the advantageous, new and useful results obtained, the new and useful constructions, methods, steps and procedures are set forth in the appended claims.

I claim:

1. In a method of processing bituminous paving mixture to reduce the discharge of aggregate fines into the atmosphere, the steps of:

(a) providing a substantially airtight inclined drum mixer having an upper charging end and a lower discharge end;

(b) moving a heated gas stream with a velocity of from 240 to 540 feet per minute along the drum from a zone adjacent the charging end to the discharge end;

(c) feeding aggregate having a variable moisture content into the drum at the charging end;

(d) immediately heating the introduced aggregate by the heated gas stream to dry the aggregate and produce steam from the aggregate moisture content;

(e) tumbling and moving the heated aggregate along the drum toward the discharge end in the heated steam-containing gas stream;

(f) feeding a liquified asphalt composition into the tumbling heated aggregate moving through the drum at a zone generally intermediate the charging and discharge end of the drum;

(g) continuing the tumbling of the aggregate and liquified asphalt moving in the heated gas stream along the drum to coat the aggregate with the liquified asphalt;

(h) then discharging the coated aggregate from the lower discharge end of the drum;

(i) meanwhile controlling the air-fuel flow ratio of combusion producing the heated gas stream such that nearly all oxygen is consumed during combustion to generally eliminate free oxygen from the low-velocity heated gas stream moving through the drum;

(j) partially obstructing the moving aggregate and heated gas stream by placing shield means in the path of said aggregate and gas stream adjacent the discharge end of the drum to collect small particulate matter; and (k) discharging the heated gas stream from the drum discharge end through a natural draft stack with a velocity of from 425 to 900 feet per minute, whereby this velocity of the discharged gas stream in the stack is insufficient to entrain aggregate fines therein and whereby said fines are contained in the discharge coated aggregate.

2. The method set forth in claim 1 including the steps of producing a burner flame extending from adjacent the charge end of the drum mixer into the steam zone; and passing the aggregate through the burner flame to assist in drying the aggregate and producing the steam.

3. The method set forth in claim 1 in which the moisture content of the aggregate fed into the drum mixer is between 1% and 7% by weight of the aggregate.

4. In a method of making a bituminous paving mixture including the steps of:

(a) supplying aggregate containing variable quantities of small particle fines and moisture into an upper charge end of an inclined, substantially airtight, rotatable drum;

(b) admitting a controlled quantity of air and fuel into burner means mounted on the drum adjacent the charge end of the drum;

(c) comsuming said air and fuel in the burner means by combustion to produce a burner flame and a generally oxygen free, heated gas stream;

(d) moving the heated gas stream through the drum from adjacent the charge end toward a discharge end with a velocity of from 240 to 540 feet per minute;

(e) heating the aggregate immediately upon it entering the drum in the burner flame and heated gas stream to partially dry the aggregate and to produce steam from the contained moisture of the aggregate in a steam zone located adjacent the charge end of the drum;

(f) tumbling and moving the heated and partially dried aggregate together with the steam and heated gas stream along the drum from the steam zone to an adjacent asphalt injection zone;

(g) injecting a liquidfied asphalt composition into the drum and contacting the tumbling moving aggregate in the asphalt injection zone;

(h) continuing moving and tumbling the aggregate and liquified asphalt along the drum through a coating zone to coat the aggregate with the liquified asphalt;

(i) partially obstructing the moving aggregate and heated gas stream by placing shield means in the path of said aggregate and gas stream adjacent the discharge end of the drum to collect small particulate matter;

(j) then discharging the coated aggregate from the discharge end of the drum;

(k) providing a natural draft stack at the discharge end of the drum; and (l) discharging the low-velocity heated gas stream from the drum discharge end through the natural draft stack, with a velocity of from 425 to 900 feet per minute.

5. The method set forth in claim 4 in which the aggregate moves through the drum in the range of from three to four minutes.

6. The method set forth in claim 4 including discharging approximately 50% of the steam produced in the steam zone through the natural draft stack; and discharging the remaining 50% with the coated aggregate.

7. Apparatus for making asphaltic paving mixtures including:

(a) an inclined rotatable drum mixer having a longitudinal axis and an upper charge end and a lower discharge end, with a charge opening and a discharge opening being provided in the drum mixer at the charge and discharge ends, respectively;

(b) means for rotating the drum mixer about its longitudinal axis;

(c) means adjacent the charge end for feeding aggregate into the drum mixer through the charge opening;

(d) vane means mounted on the interior of the drum mixer and arranged to tumble and move the aggregate along the interior of the drum mixer during rotation of said drum mixer;

(e) burner means positioned adjacent the charge end of the drum mixer for directing a flame into the interior of the mixer for immediately heating the aggregate fed into said drum mixer;

(f) means communicating with the burner means providing a supply of air and fuel to said burner means;

(g) means controlling the ratio of the fuel and air supplied to the burner means to produce a heated gas stream flowing from adjacent the charge end toward the discharge end;

(h) means for injecting a liquid asphaltic composition into the interior of the drum mixer downstream of the charge end for coating the heated aggregate as it moves along the interior of the drum mixer;

(i) shield means;

(j) means mounting the shield means within the interior of the drum mixer in the path of the heated gas stream, said shield means being located downstream of the liquid asphaltic composition injection means in close proximity with the discharge end of the drum mixer and out of contact with the burner means flame to attract small particulate particles mingled among the coated aggregate; and (k) natural draft stack means communicating with the discharge end of the drum mixer through which the heated gas stream passes to the atmosphere.

8. The apparatus defined in claim 7 in which the shield means includes circular plate means mounted concentrically within the drum mixer; and in which the plate means has a diameter approximately one half of the drum mixer diameter.

9. The apparatus defined in claim 8 in which the circular plate means includes a pair of semicircular plates; in which one of the plates is fixed with respect to the drum mixer; and in which hinge means pivotally mount the other of said plates on said one plate for swinging movement with respect thereto.

10. The apparatus defined in claim 9 in which latch means is mounted on the other of the pair of plates to prevent pivotal movement of said other plate during operation of the drum mixer.

11. Apparatus for making asphaltic paving mixtures including:

(a) an inclined rotatable drum mixer having a longitudinal axis and an upper charge end and a lower discharge end, with a charge opening and a discharge opening being provided in the drum mixer at the charge and discharge ends, respectively;

(b) means for rotating the drum mixer about its longitudinal axis;

(c) means adjacent the charge end for feeding aggregate into the drum mixer through the charge opening;

(d) vane means mounted on the interior of the drum mixer and arranged to tumble and move the aggregate along the interior of the drum mixer during rotation of said drum mixer;

(e) burner means positioned adjacent the charge end of the drum mixer for directing a flame into the interior of the mixer for immediately heating the aggregate fed into said drum mixer;

(f) means communicating with the burner means providing a supply of air and fuel to said burner means;

(g) means controlling the ratio of the fuel and air supplied to the burner means to produce a heated gas stream flowing from adjacent the charge end toward the discharge end;

(h) means for injecting a liquid asphaltic composition into the interior of the drum mixer downstream of the charge end for coating the heated aggregate as it moves along the interior of the drum mixer;

(i) shield means including circular plate means mounted concentrically within the interior of the drum mixer, said plate means having a diameter approximately one-half of the diameter of the drum mixer and includes a pair of semicircular plates, with one of said plates being fixed with respect to the drum mixer;

(j) hinge means pivotally mounting the other of said plates on said fixed plate for swinging movement with respect thereto;

(k) the shield means being located downstream of the liquid asphaltic composition injection means in close proximity with the discharge end of the drum mixer and out of contract with the burner means flame to attract small particulate particles mingled among the coated aggregate; and (l) natural draft stack means communicating with the discharge end of the drum mixer through which the heated gas stream passes to the atmosphere.

12. The apparatus defined in claim 11 in which latch means is mounted on the other of the pair of plates to prevent pivotal movement of said other plate during operation of the drum mixer.

* * * * *